US007413325B2

(12) United States Patent
Chen

(10) Patent No.: US 7,413,325 B2
(45) Date of Patent: Aug. 19, 2008

(54) LED BULB

(75) Inventor: Chi Gon Chen, Gueng Zhou (CN)

(73) Assignee: International Development Corporation, Roanoke, TX (US)

( * ) Notice: Subject to any disclaimer, the term of this patent is extended or adjusted under 35 U.S.C. 154(b) by 0 days.

(21) Appl. No.: 11/394,897

(22) Filed: Jun. 1, 2006

(65) Prior Publication Data

US 2007/0153518 A1 Jul. 5, 2007

Related U.S. Application Data

(60) Provisional application No. 60/754,407, filed on Dec. 28, 2005.

(51) Int. Cl.
*F21S 13/14* (2006.01)

(52) U.S. Cl. ..... 362/249; 362/252

(58) Field of Classification Search ..... 362/249–252, 362/268, 297, 307–308, 373; 257/98, 100
See application file for complete search history.

(56) References Cited

U.S. PATENT DOCUMENTS

| | | | | |
|---|---|---|---|---|
| 5,469,347 | A * | 11/1995 | Duve et al. | 362/245 |
| 5,782,555 | A * | 7/1998 | Hochstein | 362/373 |
| 6,019,493 | A * | 2/2000 | Kuo et al. | 362/335 |
| 6,218,785 | B1 * | 4/2001 | Incerti | 315/185 S |
| 6,318,884 | B1 * | 11/2001 | Hibbard et al. | 362/391 |
| 7,011,430 | B2 * | 3/2006 | Chen | 362/235 |
| 7,014,482 | B1 * | 3/2006 | Sugar | 439/135 |
| 2002/0167810 | A1 * | 11/2002 | Gelfand et al. | 362/294 |
| 2005/0018426 | A1 * | 1/2005 | Dickie | 362/287 |

* cited by examiner

*Primary Examiner*—Jong-Suk (James) Lee
*Assistant Examiner*—Julie A. Shallenberger
(74) *Attorney, Agent, or Firm*—David W. Carstens; Jeffrey G. Degenfelder; Carstens & Cahoon, LLP

(57) ABSTRACT

An LED bulb includes a hollow enclosure and a lower cover assembly. The lower cover assembly includes a circuit which permits the connecting pins to be inserted into a two hole socket in either direction. The LEDs are mounted to expose their leads to ambient air to assist in cooling. The hollow enclosure includes reflective surfaces therein and a top reflector which also may include a reflecting surface therein.

13 Claims, 3 Drawing Sheets

LED BULB

This utility patent application claims priority to Provisional U.S. Patent Application 60/754,407 filed Dec. 28, 2005 and Provisional U.S. Patent Application 60/784,613 filed Mar. 22, 2006.

This invention was not supported by federally sponsored research or development.

FIELD

The present invention pertains to replaceable light bulbs; more particularly, the present invention pertains to replaceable light bulbs where LEDs are used as a source of light.

BACKGROUND

In the past several years, there has been an explosion in the use of LEDs in a variety of applications. Initially, LEDs were small and did not provide a significant degree of illumination. Accordingly, LEDs were often used as indicator lights and not as a source of illumination. However, as the technology surrounding the construction and use of LEDs has progressed, LEDs are now being used in many illumination applications where incandescent lamps were previously once used. However, since the amount of light produced by LEDs is still small in comparison to many incandescent lamps, there remains a need in the art to maximize the illumination provided by one or more LEDs and to place the LEDs in a replaceable package similar to an incandescent light for user convenience.

SUMMARY

The replaceable LED bulb of the present invention maximizes the illumination produced by a set of LEDs and places the LEDs in a package which is easily handled and replaced as needed for user convenience. In addition, the LEDs are wired so that the prongs or terminal pin connectors located on the base of the LED bulb of the present invention may be placed in a socket which provides the required DC electrical energy in either direction. It is well known that LEDs generate heat which eventually leads to LED failure. To prolong the life of the LEDs within the LED bulb, the mounting of the LEDs within the LED bulb promotes cooling of the LEDs. Maximization of the illumination provided by the replaceable LED bulb of the present invention is accomplished by the use of multiple reflective surfaces within the enclosure portion of the replaceable LED bulb to disperse the light rays emitted by the LEDs within the replaceable LED bulb enclosure so that the enclosure gives the appearance of being filled with light.

BRIEF DESCRIPTION OF THE DRAWING FIGURES

A better understanding of the replaceable LED bulb of the present invention may be had from the attached drawing figures, wherein.

DESCRIPTION OF THE EMBODIMENTS

Figure 1:
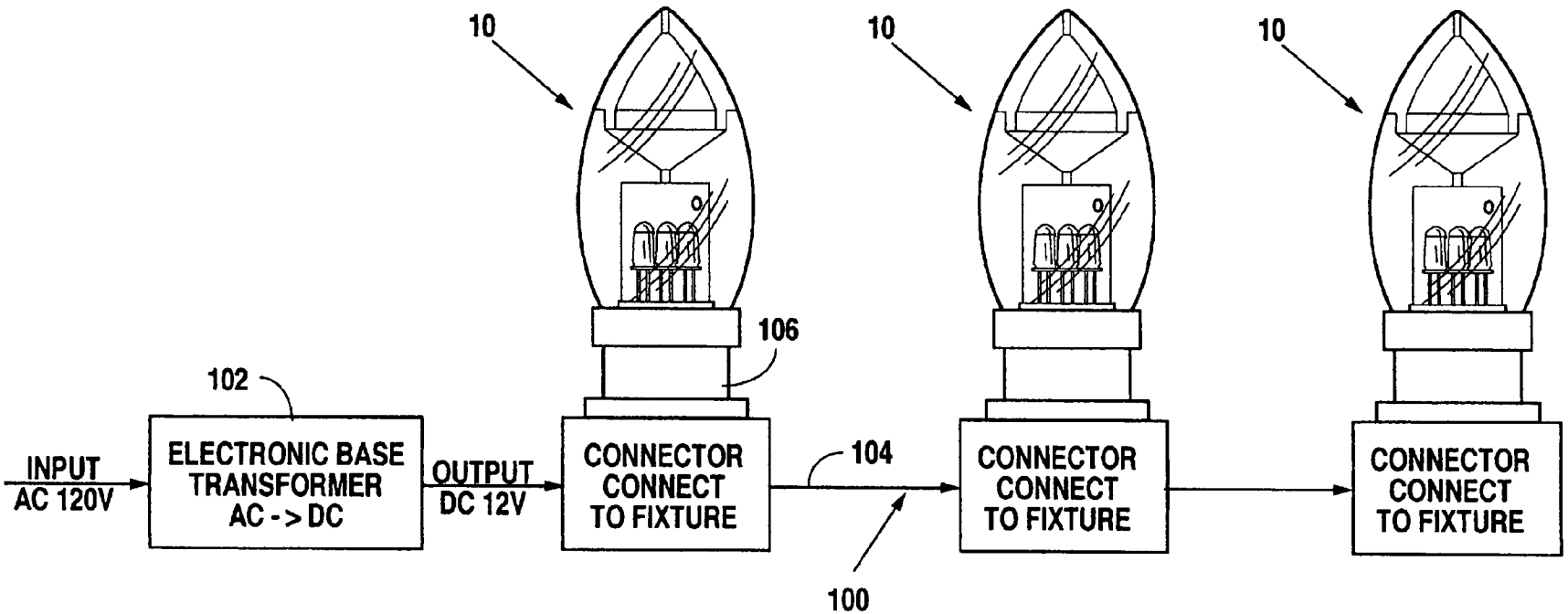
FIG. 1 is a schematic drawing of a garden light set using the replaceable LED bulb of the present invention.

While there are many applications for the replaceable LED bulb 10 of the present invention, FIG. 1 illustrates the use of the replaceable LED bulb 10 of the present invention in garden lights 100. At the left side of FIG. 1 is a source of electrical power; typically 120v AC house current. Because LEDs use low voltage direct current, the 120v AC house current passes through a transformer 102 which converts the 120v AC house current to 12v DC. The 12v DC passes through an electrical conductor or wires 104 to a plurality of sockets 106, each of which has two openings sized to accommodate the pin connectors on the bottom of the replaceable LED bulb 10 of the present invention. Thus, the replaceable LED bulbs 10 of the present invention are removable from the sockets 106 for replacement as needed. In addition, if the user of a set of garden lights 100 wants to use replaceable LED bulbs 10 of different colors, all that is necessary is to remove a selected replaceable LED bulb 10 from the socket 106 and replace it with a replaceable LED bulb having the desired color.

As may be seen in FIGS. 1, 2A, 2B, 3A, and 3B, in the preferred embodiment of the replaceable LED bulb 10 of the present invention, a bullet or flame shaped enclosure assembly 20 is used. Those of ordinary skill in the art will understand that numerous other shaped enclosure assemblies may be used depending on the size constraints and the amount of dispersion needed for the light emitted from the LEDs 90.

Figure 2A:
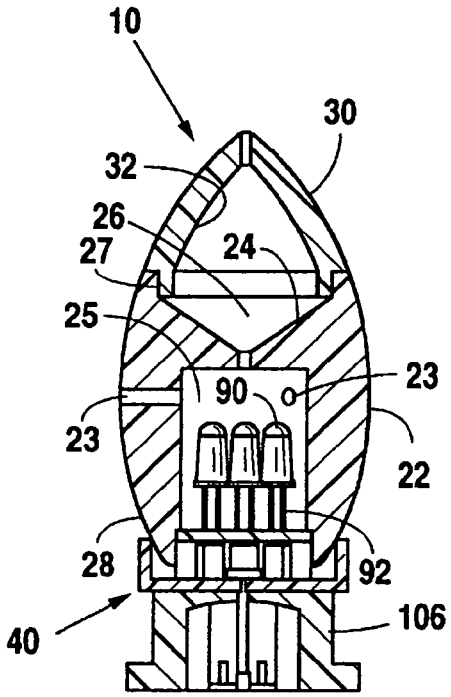
FIG. 2A is an elevational view of the replaceable LED bulb in partial section.
Figure 2B:
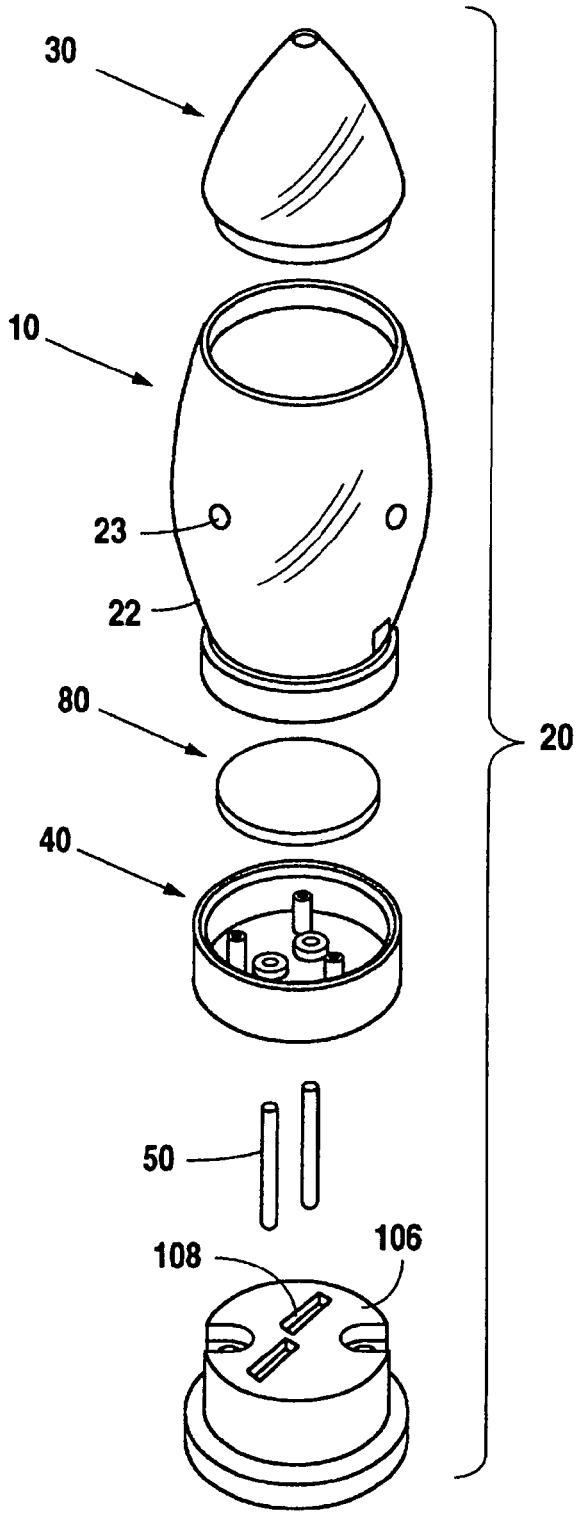
FIG. 2B is an exploded perspective view of the replaceable LED bulb shown in FIG. 2A with the LEDs removed.
Figure 3A:
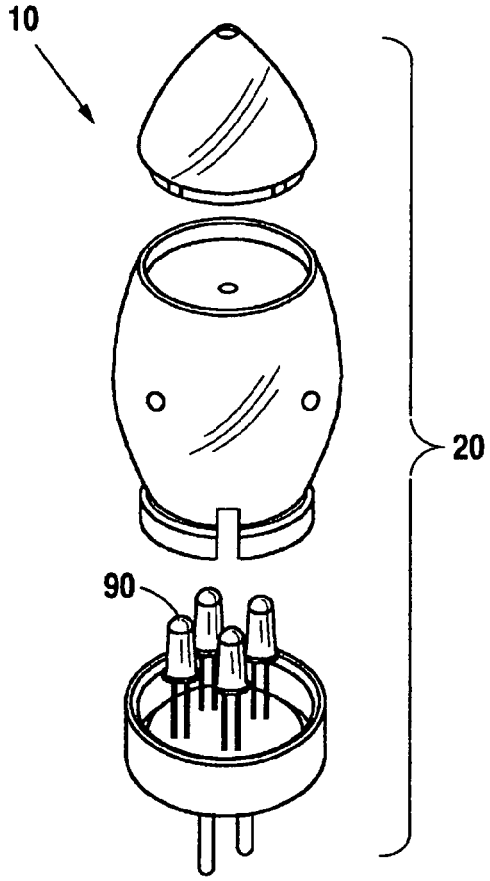
FIG. 3A is an exploded perspective view similar to FIG. 2B showing a replaceable LED bulb with four LEDs.
Figure 3B:
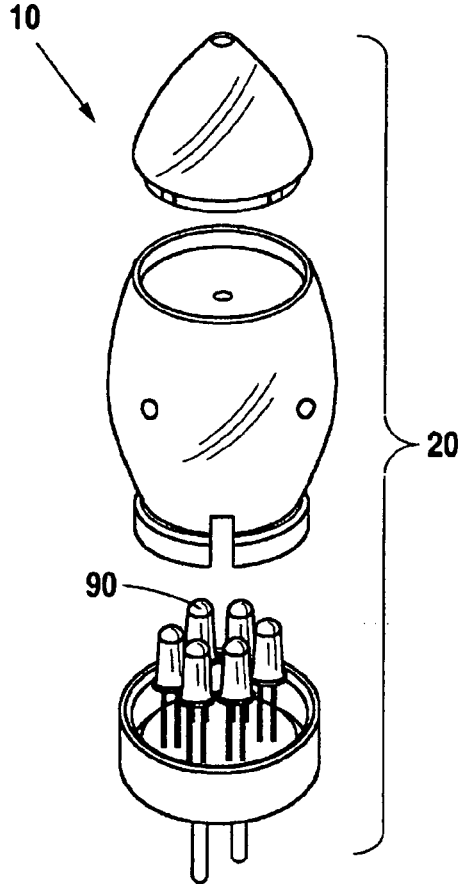
FIG. 3B is an exploded perspective view similar to FIG. 2B showing a replaceable LED bulb with six LEDs.

The construction of the replaceable LED bulb 10 of the present invention is best understood by reference to FIGS. 2A and 2B. As may be seen in FIG. 2A, the illustrated replaceable LED bulb 10 includes three LEDs 90. As shown in FIGS. 3A and 3B others numbers of LEDs 90 may be used in the replaceable LED bulb 10 without departing from the scope of the invention. While it is expected that white or off-white LEDs 90 will be used in most applications, any color LED 90 or any combination of colored LEDs 90 may be used. The LEDs 90 are located in an opening 25 within the central hollow enclosure portion 22 of the enclosure assembly 20. The top portion 21 of the central portion 22 of the enclosure assembly 20 includes a concave opening 26. Fitting into a shouldered recess 27 at the top of the concave opening 26 is a substantially conical hollow top portion 30. Surrounding the bottom 28 of the central portion 22 of the enclosure assembly 20 is a lower cover assembly 40 through which two terminal pins 50 extend.

Figure 4:
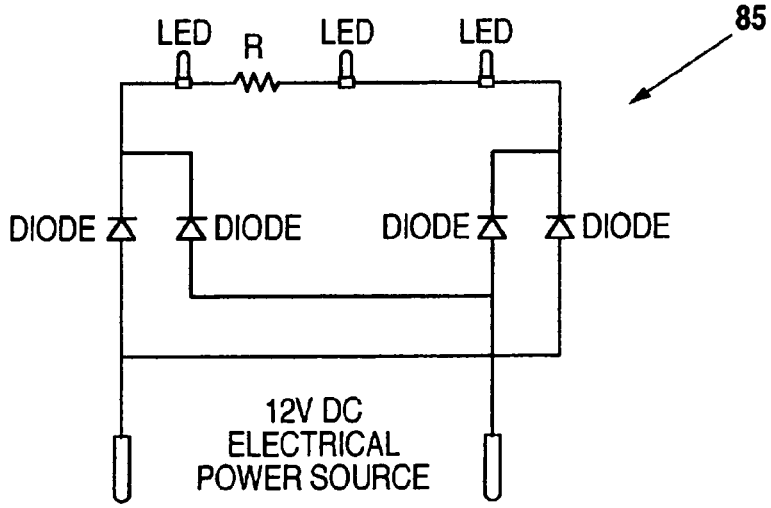
FIG. 4 is a circuit diagram of the internal circuitry within the replaceable LED bulb which allows the pins on the bottom of the replaceable LED bulb to be placed in either opening in a socket having two openings.

The terminal pins 50 receive electrical energy when plugged into openings 108 in a socket 106. This electrical energy is conducted to an integrated circuit on a chip or wafer 80 sized to fit within the lower cover assembly 40. An example of the integrated circuit 85 included in the chip or wafer 80 appears in FIG. 4. The arrangement of the diodes and the resistor R assure that the terminal pins 50 can be put in either opening 108 in a two-holed socket 106 and electrical energy of the proper polarity will be supplied to the LEDs 90. As known to those of ordinary skill in the art LEDs are electrically polarized and will only illuminate when properly polarized DC electrical energy is supplied.

The bottom of the substantially conical hollow top portion 30 of the bullet-shaped enclosure assembly 20 is shaped to fit within a shoulder recess 27. The space 25 within the enclosure assembly 20 of sufficient size to accommodate one or more LEDs 90. When illuminated, the emitted light from the LEDs 90 will reflect from the sides of the concave opening 26 and from the interior surface 32 of the substantially conical hollow top portion 30. This reflection of emitted light will cause the central portion 22 and the substantially conical hollow top portion 30 of the enclosure assembly 20 to give the appearance that the enclosure assembly 20 of the replaceable LED bulb 10 is filled with light.

Because LEDs 90 which are used for illumination purposes also emit a lot of heat, the central portion 22 of the bullet-shaped enclosure assembly 20 includes one or more vent holes 23 to promote the entry of ambient air into the space 25 within the bullet-shaped enclosure assembly 20. To provide additional cooling, the LEDs 90 are mounted so that they are elevated to a position near the midst of the opening 25 within the enclosure assembly 20. Such mounting exposes a portion of the leads 92 from the LEDs 90 to ambient air. This exposure of the a portion of the leads 92 extending outwardly from the enclosure assembly 20 of the replaceable LED bulb 10 to ambient air assists in conducting heat away from the LEDs 90.

Connecting the leads 92 from the LEDs 90 to a power source is a pair of terminal pins 50. The terminal pins 50 are connected to an electrical circuit 85 within the replaceable LED bulb 10 which permits electrical energy to flow only in only one direction to the one or more LEDs 90 within the replaceable LED bulb 10. Such circuits 85 are well known to those of ordinary skill in the art who use a polarized power source to provide electrical energy. The terminal pins 50 are the same size so that there is no need to identify the polarity of the LEDs 90, and the replaceable LED bulb 10 of the present invention may be placed in a socket 106 irrespective of the orientation of the terminal pins 50.

In FIG. 3 it may be seen that the light emitted by the LEDs 90 is dispersed by multiple reflective surfaces. One reflective surface is within the LED 90 itself. Another reflective surface is the side walls 24 of the concave opening 26 formed in the top of the central portion 22 of the enclosure assembly 20. A second reflective surface 32 which reflects light from the individual LEDs 90 is the inside 32 of the conical opening within the substantially conical hollow top portion 30 of the enclosure assembly 20.

Manufacture of the replaceable LED bulb 10 of the present invention may be accomplished in a variety of ways; however, workable replaceable LED bulbs 10 have been produced using the following steps:

mounting the electrically polarized LEDs 90 to a miniaturized circuit 85 having terminal pins 50 extending therefrom. The miniaturized circuit 85 assures that the LEDs 90 receive DC electrical energy in the needed polarity to properly illuminate;

placing the LEDs 90 and a wafer containing the miniaturized circuit 85 in the lower cover assembly 40;

placing the central portion 22 of the enclosure assembly 20 including at least one reflective surface therein over the LEDs 90 such that central portion 22 of the enclosure assembly 20 of the replaceable LED bulb 10 engages the lower cover assembly 40;

placing the hollow top portion 30 including at least one reflective surface 32 therein on the central portion 22 of the enclosure assembly 20.

While the replaceable LED bulb 10 of the present invention has been described in terms of its preferred embodiment in what some might call a flame or bullet shaped enclosure assembly, those of ordinary skill in the art will understand that numerous other designs of enclosure assemblies may be used without departing from the disclosed invention. Such other systems may include cylinders with round or flat sides, spheres, cones, or the typical bulbous shape found in many incandescent light bulbs.

While the present invention describing a replaceable LED bulb has been disclosed according to a preferred embodiment, those of ordinary skill in the art will understand that other embodiments of the disclosed invention will be enabled by the foregoing disclosure. Such other embodiments shall be included within the scope and meaning of the appended claims.

What is claimed is:

1. A replaceable decorative LED light bulb comprising:

one or more LEDs having leads extending therefrom;

a mounting for said one or more LEDs, said mounting including:

a lower cover assembly constructed and arranged for positioning the leads to said one or more LEDs to expose a portion of said leads to said one or more LEDs to ambient air so that heat may be conducted away from said leads to said two terminal pins electrically connected to one or more LEDs;

a circuit allowing said two terminal pins electrically connected to said leads to said one or more LEDs to be connected to a polarized source of electrical power in either direction;

an enclosure for said one or more LEDs, said enclosure including a hollow space for said one or more LEDs and the exposure of said leads to said one or more LEDs to ambient air;

a first reflective surface formed on the exterior of a concave opening within said hollow enclosure for dispersing the light emitted by said one or more LEDs;

a second reflective surface formed within a substantially conical hollow top portion of said housing above said one or more LEDs;

whereby, when illuminated, said hollow enclosure gives the appearance of being filled with light.

2. The replaceable decorative LED light bulb as defined in claim 1 wherein said hollow enclosure is bullet shaped.

3. A socket mounted lighting system including one or more electrically polarized LEDs as a light source, said socket mounted lighting system comprising:

a mounting base, said mounting base including a lower cover assembly constructed and arranged for positioning leads extending from said one or more LEDs to expose a portion of said leads to ambient air so that heat may be conducted away from said leads to two terminal pins electrically connected to one or more LEDs, wherein the two terminal pins provide electrical energy to the electrically polarized LEDs irrespective of the orientation of the terminal pins in the mounting base to the socket;

a vented enclosure constructed and arranged for interfitment with said mounting base, said vented enclosure including a first hollow space for surrounding said one or more electrically polarized LEDs, said first hollow space having at least one vent for exposing said leads to ambient air, said vented enclosure further including a second hollow space positioned above said first hollow space, said second hollow space defining a first reflective surface concave to the one or more LEDs, and a second substantially conical convex reflective surface positioned above the first reflective surface for reflection of the light emitted by the one or more electrically polarized LEDs whereby, when illuminated, said vented enclosure gives the appearance of being filled with light.

4. The socket mounted lighting system as defined in claim 3 wherein said vented enclosure is bullet shaped.

5. The socket mounting lighting system as defined in claim 3 wherein said vented enclosure includes a separable top portion.

6. A replaceable bulb including at least one LED light source, said replaceable bulb comprising:

a mounting base, said mounting base constructed and arranged for positioning leads extending from said one or more LED light source to expose a portion of said leads to ambient air so that heat may be conducted away from said leads to two terminal pins electrically connected to one or more LEDs, wherein the two terminal pins conduct electrical energy to the at least one LED light source;

a circuit between said two terminal pins and said leads for receiving DC electrical energy from said two terminal pins and transforming said DC electrical energy into a polarity usable by the at least one LED light source, said circuit being included within said mounting base;

a hollow enclosure constructed and arranged to be supported by said mounting base, said hollow enclosure being further constructed and arranged to surround said at least one LED light source, said hollow enclosure having at least one vent for exposing said leads to ambient air, said hollow enclosure further including a first reflecting surface formed within said hollow enclosure and positioned above and concave to the at least one LED light source and a substantially conical hollow top portion having an interior surface comprising a second reflecting surface positioned above said first reflecting surface and convex to the at least one LED light source for dispersing the light emitted by the at least one LED light source to give the appearance that said hollow enclosure is filled with light.

7. A decorative garden lighting system, said garden lighting system comprising:

a plurality of sockets, each of said sockets having two polarized socket openings;

an electrical conductor for providing electrical energy to said plurality of sockets from a source of electrical energy;

a plurality of replaceable decorative bulbs, each of said plurality of replaceable decorative bulbs including at least one LED as a light source; each of said plurality of replaceable bulbs including:

a mounting base, said mounting base including constructed and arranged for positioning leads extending from said at least one LED to expose a portion of said leads to ambient air so that heat may be conducted away from said leads to two terminal pins electrically connected to said at least one LED, wherein the two terminal pins provide electrical energy to said at least one LED;

a circuit included within said mounting base which electrically connects said terminal pins to said leads, said circuit permitting said two terminal pins to be inserted in said polarized socket openings of one of said sockets in either direction;

an enclosure constructed and arranged for interfitment with said mounting base, said enclosure including a first hollow space for surrounding-said at least one LED, said first hollow space having at least one vent for exposing said leads to ambient air, said enclosure further including a second hollow space positioned above said first hollow space, said second hollow space defining a first reflective surface concave to said at least one LED, and a second substantially conical convex reflective surface positioned above the first reflective surface for the reflection of light emitted by said at least one LED.

8. A method of manufacturing a replaceable decorative light bulb including at least one electrically polarized LEDs, said method comprising the steps of:

forming a first assembly, comprising mounting leads extending from said at least one electrically polarized LED to a circuit having two terminal pins extending therefrom, wherein said circuit electrically connects said two terminal pins to said at least one electrically polarized LED and enables electrical energy to flow to the at least one electrically polarized LEDs to cause it to illuminate irrespective of the orientation of said terminal pins in a socket having two polarized socket openings;

mounting said first assembly in a lower cover assembly so that said two terminal pins extend from the bottom of said lower cover assembly;

constructing an enclosure assembly constructed and arranged for interfitment with said lower cover assembly, said constructing step comprising forming a first hollow space within said enclosure assembly, said first hollow space including at least one vent hole extending to the exterior of said enclosure assembly permitting ambient air to access said first hollow space; and a second hollow space formed within said enclosure assembly and positioned above said first hollow space, said second hollow space defining a first reflective surface concave to the first hollow space, and a second substantially conical convex reflective surface positioned above the first reflective surface mounting said lower cover assembly to said enclosure assembly by inserting said at least one electrically polarized LED attached to said lower cover assembly into said first hollow space while permitting a portion of said leads to be exposed to ambient air by means of said at least one vent hole extending to the exterior of said enclosure.

9. The socket mounted lighting system as defined in claim 3 wherein said at least one vent comprises a first vent hole fluidly connecting said first and second hollow spaces and a second vent hole fluidly connecting the second hollow space to ambient air.

10. The decorative garden lighting system as defined in claim 7 wherein said at least one vent comprises a first vent hole fluidly connecting said first and second hollow spaces and a second vent hole fluidly connecting the second hollow space to ambient air.

11. A replaceable decorative LED light bulb comprising:

at least one LED having leads extending therefrom;

a lower cover assembly constructed and arranged for positioning said leads so as to expose a portion of said leads to ambient air so that heat may be conducted away from said leads;

two terminal pins extending through the bottom said lower case assembly, said pins being constructed and arranged for plugging into a socket attached to a source of electrical energy;

an integrated circuit electrically connecting said two terminal pins to said leads, wherein said integrated circuit receives electrical energy from said two terminal pins and transforms said electrical energy into a polarity usable by the at least one LED irrespective of the orientation of the terminal pins in said socket, said circuit being included within said lower cover assembly;

an enclosure assembly comprising a central portion having its bottom constructed and arranged for interfitment with said lower cover assembly, said central portion having a first hollow space formed in the bottom of said central portion for receiving said at least one LED, said first hollow space having at least one vent for exposing said leads to ambient air, said central portion further including an opening formed in the top of said central portion defining a concave first reflective surface; and a top portion constructed and arranged for interfitment with the top of said central portion, said top portion including an interior surface comprising a second reflecting surface;

whereby, when illuminated by said at least one LED, said enclosure assembly gives the appearance of being filled with light.

12. The replaceable decorative LED light bulb as defined in claim 11 wherein said at least one vent comprises a first vent hole fluidly connecting said first hollow space to the exterior of the top of said central portion and a second vent hole fluidly connecting the interior surface of said top portion to ambient air.

13. The replaceable decorative LED light bulb as defined in claim 11 wherein said enclosure assembly is ogive shaped.

* * * * *

UNITED STATES PATENT AND TRADEMARK OFFICE

CERTIFICATE OF CORRECTION

PATENT NO. : 7,413,325 B2
APPLICATION NO. : 11/394897
DATED : August 19, 2008
INVENTOR(S) : Chen It is certified that error appears in the above-identified patent and that said Letters Patent is hereby corrected as shown below:

In Claim 8, Column 6, lines 2 and 17, please delete "LEDs" and insert --LED-- therefore.

Signed and Sealed this

Thirtieth Day of December, 2008

JON W. DUDAS
*Director of the United States Patent and Trademark Office*